US006717056B2

(12) United States Patent
Rivelli et al.

(10) Patent No.: US 6,717,056 B2
(45) Date of Patent: Apr. 6, 2004

(54) FATIGUE-RESISTANT CONDUCTIVE WIRE ARTICLE

(75) Inventors: Patrick Rivelli, Palo Alto, CA (US); Harry Kopelman, Atlanta, GA (US)

(73) Assignee: HAK Consulting, LLC, Atlanta, GA (US)

( * ) Notice: Subject to any disclaimer, the term of this patent is extended or adjusted under 35 U.S.C. 154(b) by 0 days.

(21) Appl. No.: 09/880,987

(22) Filed: Jun. 13, 2001

(65) Prior Publication Data

US 2002/0007958 A1 Jan. 24, 2002

Related U.S. Application Data

(60) Provisional application No. 60/211,348, filed on Jun. 13, 2000.

(51) Int. Cl.[7] ..... H01B 7/18
(52) U.S. Cl. ..... 174/102 R; 174/105 R
(58) Field of Search ..... 174/28, 102 R, 174/105 R, 102 A, 102 SP, 108

(56) References Cited

U.S. PATENT DOCUMENTS 4,988,833 A * 1/1991 Lai ..... 174/69

FOREIGN PATENT DOCUMENTS

JP 2-190723 * 7/1990
JP 9-306253 * 11/1997

* cited by examiner

*Primary Examiner*—Chau N. Nguyen
(74) *Attorney, Agent, or Firm*—William H. Dippert; Reed Smith LLP

(57) ABSTRACT

The invention includes an insulated, fatigue-resistant conductor formed of a conductive wire, a polymeric insulative sleeve having inner and outer layers, and a shape memory alloy (SMA) element disposed between the two layers. The SMA has a preferred thickness between 2 and 50 microns, an undeformed austentitic state, an $A_f$ between about −10° C. and 35C., a pseudoelasticity character above its $A_f$, and demonstrates a stress/strain recovery greater than 3% above its $A_f$. Also disclosed is a method of forming the conductor, and a pacemaker which uses conductor as leads.

20 Claims, 3 Drawing Sheets

FATIGUE-RESISTANT CONDUCTIVE WIRE ARTICLE

This application claims priority to U.S. Provisional Patent Application Ser. No. 60/211,348 filed on Jun. 13, 2000, which is incorporated in its entirety herein by reference.

BACKGROUND OF THE INVENTION

In many applications, insulated conductive wires are exposed to constant bending forces. One example occurs with an implanted pacemaker, where the pacemaker electrodes are bending with each heart beat. Another common example occurs in any type of machine having two relatively moving parts connected by a conductive wire.

In applications of conductive wires such as these, wire fatigue or insulator fatigue may become a serious limitation to the lifetime of the integrity of the conductor. Fatigue may be a problem particularly where the insulative material is subject to repeated stress fatigue and/or it is impractical to check and replace wires. This is the problem currently encountered with pacemaker leads, where the nature of polymer is limited by the need for biocompatibility and there is considerable expense and medical risk in replacing the leads.

SUMMARY OF THE INVENTION

The invention includes, in one aspect, an insulated, fatigue-resistant conductor article having as its elements, a conductive wire, a polymeric insulative sleeve having inner and outer layers, and a shape memory alloy (SMA) element having a thickness between 2 and 250 microns, preferably 2–100, more preferably 2–50 microns, an undeformed austentitic state, an $A_f$ between about −10° C. and 35 C., a pseudoelasticity character above its $A_f$, and demonstrating a stress/strain recovery greater than 3% above its $A_f$.

The wire is encased in an inner layer of the sleeve, the inner layer of the sleeve is surrounded by the SMA element, and the SMA element is encased in the outer layer of the sleeve. The SMA element can undergo pseudoelastic expansion by stress-induced martensite in response to bending of the conductor article, to resist bending fatigue and thereby prevent the polymeric insulative sleeve from cracking or splitting in response to fatigue in the sleeve material.

The SMA element may have a selected a selected curvature along its length in its austentite form, biasing the article toward this curvature in the absence of a bending force applied to the wire. Alternatively, the SMA element may be substantially straight along its length in its austentite form, biasing the article toward a straight condition in the absence of a bending force applied to the wire.

In various embodiments, the SMA element is (i) a thin-film ribbon helically wound about the inner-sleeve layer, wherein the ribbon has a thickness of between about 2 and 100 microns, a ribbon width between about 0.5–20 mm, and where the ribbon may have a variable pitch along its length, producing a SMA material gradient along the length of the article; (ii) a thin-film cylindrical sleeve having a thickness preferably of between about 2 and 50 microns; (ii) an SMA wire or ribbon braid, (iv) a coiled SMA wire; or (v) a plurality of elongate SMA wires or ribbons, each extending substantially along the length of the article between the two sleeve layers.

The inner and outer insulative sleeves may have the same or have different polymer compositions; where the article is a pacemaker lead or other body-implantable wire, the outer sleeve layer is formed of a biocompatible polymer.

In another aspect, the invention includes a pacemaker having, as pacemaker leads, conductive articles in accordance with the article above.

In still another aspect, the invention includes a method of forming the conductive article above. The method uses the elements of: an elongate conductive wire, a polymeric material, and an elongate thin-film shape memory alloy (SMA) element having a thickness between 2 and 250 microns, an undeformed austentitic state, an $A_f$ between about −10° C. and 35 C., a pseudoelasticity character above its $A_f$, and demonstrating a stress/strain recovery greater than 3% above its $A_f$. These elements are combined by coextrusion to form the wire article. The article formed by coextrusion may lack the outer polymer sleeve, in which case the article is further treated to coat the article with an outer polymer coating, e.g., a biocompatible polymer coating.

These and other objects and features of the invention will become more fully apparent when the following detailed description of the invention is read in conjunction with the accompanying drawings.

DETAILED DESCRIPTION OF THE INVENTION

A. Embodiment with Helically Wound SMA Element

Figure 1:
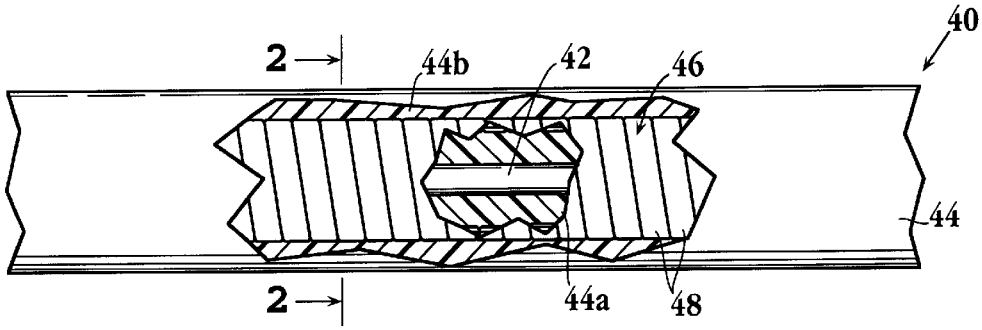
FIG. 1 shows a side-sectional view of a portion of a conductor article constructed according to one embodiment of the invention.
Figure 2:
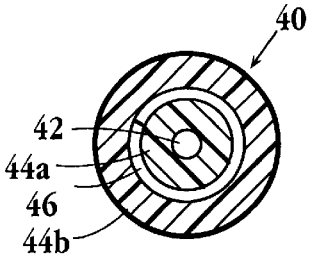
FIG. 2 is a cross-sectional view of the article in FIG. 1, taken along section plane 2—2 in FIG. 1.

FIGS. 1 and 2 show, in side sectional and cross-sectional views, respectively, a portion of an insulated conductive article 40 constructed according to one preferred embodiment of the invention.

The article includes an elongate conductive wire extending along the length of the article. The wire, shown at 42 in FIGS. 1 and 2, is formed of any conductor material, such as copper, silver, platinum irridium, or alloys thereof, or a conductive polymer, and has any selected thickness/diameter, and cross-sectional shape, depending on intended use. A preferred wire for use in a pacemaker lead has a diameter between 0.1 to 3 mm.

A polymeric insulative sleeve 44 in the article has inner and outer sleeve layers 44*a*, 44*b*, respectively. The sleeve is formed of any flexible, insulative, polymeric material, such as polyethylene, polypropylene, silicone rubber, polyurethane, and polyimide. The sleeve thickness, i.e., the combined thickness of the inner and outer sleeve layers, may be between several microns up to 1 cm or more, depending on application. In the embodiment in which the article is a pacemaker lead, the polymer is preferably silicone rubber and the total article thickness is between about 0.3 to 3 mm. The inner and outer sleeve layers may be different polymer materials. For example, where the article is used as a pacemaker, the inner sleeve layer may be a polymer such as polyimide, and the outer sleeve layer, a biocompatible polymer, such as silicone rubber.

An elongate shape memory alloy (SMA) element 46 in the article is formed of a helically wound thin-film SMA ribbon. The ribbon bands, such as shown at 48 in FIG. 1, overlap as shown to form a solid cylindrical structure. Alternatively, the ribbons may be wound in a coiled, non-overlapping configuration. The SMA ribbon is formed of a known shape memory alloy, such as nickel/titanium (reference) or nickel/titanium chromium. The ribbon forming the coil has a preferred thickness between 2–100 microns, preferably 2–50 microns. It is formed preferably by sputtering a selected NiTi alloy onto a substrate, e.g., silicon substrate coated with an etchable surface coating, to the desired film thickness, and released from the substrate by etching the substrate coating. Before of after release, the film may be cut, for example, into a ribbon shape, using laser, mechanical or photolithographic cutting methods. Before or after release, the thin-film material is annealed in a desired austentitic state by heating. e.g., to 500° C., then cooled at a desired rate. Methods of forming SMA thin films with desired SMA properties are described, for example, in U.S. Pat. No. 5,061,914, which is incorporated by reference herein. The thin-film material may be further processed to include fenestration or openings (not shown) in the ribbon by photolithographic processing of the thin film. Such fenestrations can be designed to enhanced desired wire properties, e.g., preferential bending in certain directions.

Figure 14:
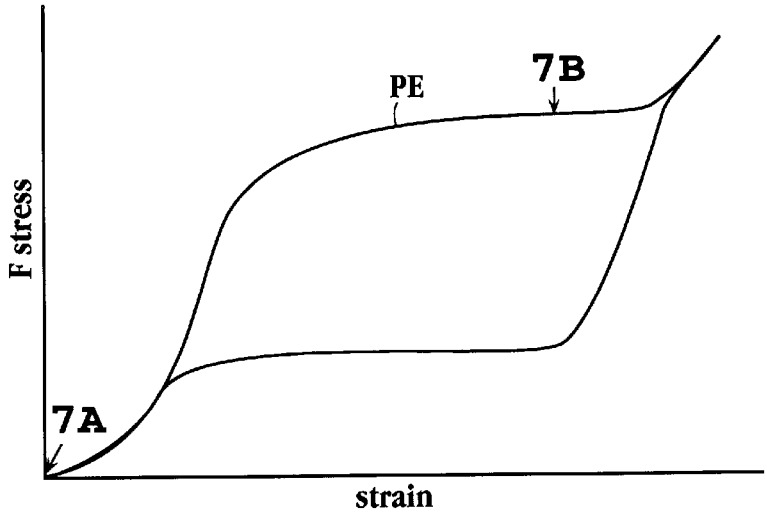
FIG. 14 shows the stress strain curve of SMA elements in the FIG. 13 article during application of stress to the elements.

In particular, the thin-film ribbon is formed under conditions, and with an alloy composition that gives an Af (final temperature at which the element is in an austentitic form) of between −10° C. and 35° C., more preferably between 0° C. and 35° C., and demonstrates pseudoelasticity character above its Af, meaning that the element has a stress strain profile, such as illustrated in FIG. 14, in which additional applied stress is accommodated by an elastic "rubber-like" stretching of the material, with very little increase in strain in the material (e.g., sma-inc.com), caused by stress-induced martensite formation. The stretching that occurs under substantially constant stress is due to increasing conversion of austentitic crystal formation in the material to its martensitic state. Similarly, when the stress is released, the material return substantially elastically to its predisposed austentite state, as the stress-induced martensite phase converts to austentite. If Md is the highest temperature at which the SMA shows stress-induced martensite behavior, the Md value is preferably higher than the element's Af, e.g., 5°–25° C. higher. Methods of forming SMA materials with this property are known (see, for example, sma-inc.com) and considered below.

In addition, the SMA thin-film ribbon preferably demonstrates a stress/strain recovery greater than 3% above its Af. This characteristic defines the degree of pseudoelasticity of the material. A 3% recovery value means that an SMA wire can be stretched elastically, under conditions of stress-induced martensite, at least 3% above its unstressed length, and fully return to its original length. This condition will be met when the stretching occurs between the element's Af and Md temperatures. Methods for producing SMA with this property are known (see, e.g., sma-inc.com).

Typically, and as indicated above, the SMA element is formed in a desired austentite shape, e.g., helically wrapped coiled ribbon, and annealed by heating about its annealing temperature, e.g., 500° C. In the present case, an SMA thin-film ribbon is wrapped about a cylindrical mandrel having a desired diameter (the inner diameter of the SMA coil in its austentite shape, then annealed. The SMA element in its annealed, undeformed austentite state may have a selected curvature or may be substantially straight. In either case, this shape will bias the conductor article containing the SMA element toward this undeformed state.

In construction, wire 42 is encased in sleeve inner layer 44*a*, the inner layer of the sleeve is surrounded by SMA element 46, and the SMA element is encased in the outer layer of the sleeve. The SMA element can undergo pseudoelastic expansion by stress-induced martensite in response to bending of the conductor article, to resist bending fatigue and thereby prevent the polymeric insulative sleeve from cracking or splitting in response to fatigue in the sleeve material.

The wire article may be formed by conventional method for forming insulated wires with coaxial components. For example, the conductive wire, inner insulative polymer, and helically wound cylindrical SMA element can be coextruded to form a three-layer construction which can then be coated, e.g., by dipping with a polymer that will form the outer sleeve layer. Alternatively, the article can be formed by coextruding all four layers. In another method, the conductive wire is placed within the SMA element and polymer material is infused between the two to form a three-layer construction, which can then be coated with an outer polymer layer. Where the article is used as a pacemaker lead, or other body-implantable lead, the outer layer is a biocompatible polymer, such as silicone rubber.

B. Alternative Embodiments of the Invention

This section considers other embodiments and features of the invention, again with reference to the elements and states considered above.

Figure 4:
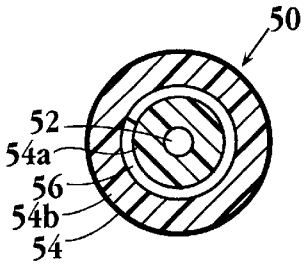
FIG. 4 is a cross-sectional view of the article in FIG. 3, taken along section plane 4—4 in FIG. 3.
Figure 3:
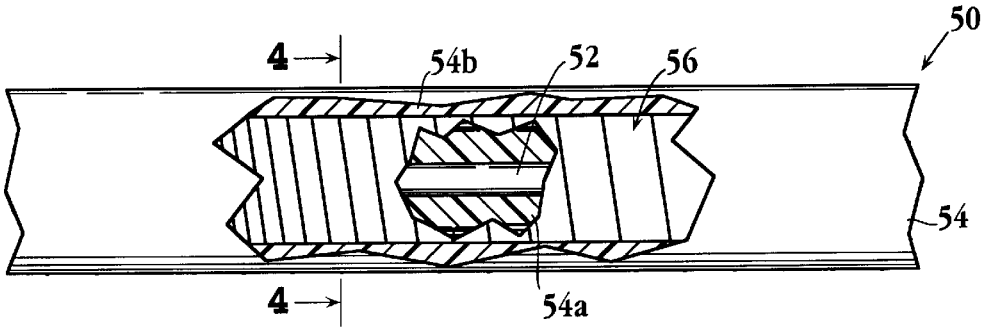
FIG. 3 shows a side-sectional view of a portion of a conductor article constructed according to a second embodiment of the invention.

FIGS. 3 and 4 illustrate a conductive wire article 50 formed in accordance with another embodiment of the invention. The article generally includes, similar to article 40, a conductive wire 52, a helically wound cylindrical SMA element 56 which is coaxially disposed with respect to the wire, and a polymer sleeve 54 encasing the wire and SMA element. The polymer sleeve includes an inner sleeve layer 54A disposed between wire 52 and element 56, and an outer sleeve layer 54B covering element 56.

Article 50 differs from article 40 in that helically wound element 56 varies in helical pitch along its length, as seen in the cutaway view in FIG. 3. More particularly, the helical ribbon windings are formed with greater ribbon-band overlap on progressing in a right-to-left direction in the figure, producing an SMA-material gradient along the length of the article, or along selected portions of the article's length. The gradient may impart greater resistance to bending in a left-to-right direction, and/or greater resistance to wire fatigue. The gradient could also be created with a gradient or ribbon width or thickness, or area of ribbon fenestrations.

The article may be formed substantially as described for article 40, except that the element itself, in its production, requires the gradient ribbon wrapping shown.

Figure 6:
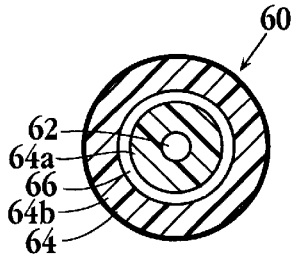
FIG. 6 is a cross-sectional view of the article in FIG. 5, taken along section plane 6—6 in FIG. 5.
Figure 5:
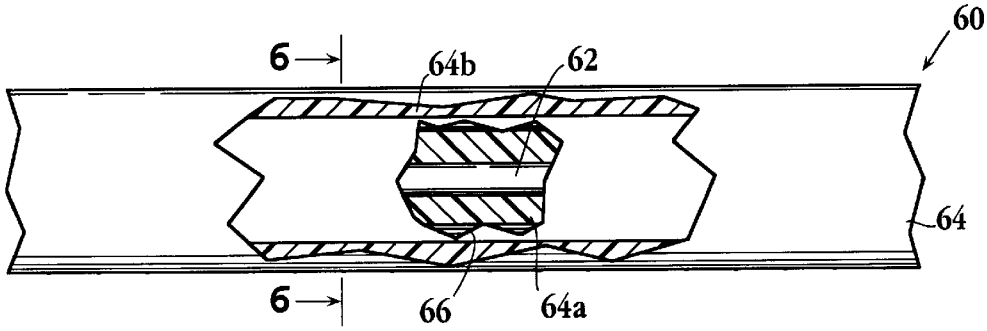
FIG. 5 shows a side-sectional view of a portion of a conductor article constructed according to a third embodiment of the invention.

FIGS. 5 and 6 illustrate a conductive wire article 60 formed in accordance with a third embodiment of the invention. The article generally includes, similar to article 40, a conductive wire 62, a cylindrical SMA element 66 which is coaxially disposed with respect to the wire, and a polymer sleeve 64 encasing the wire and SMA element. The polymer sleeve includes an inner sleeve layer 64A disposed between wire 62 and element 66, and an outer sleeve layer 64B covering element 66.

Article 60 differs from article 40 in that the SMA cylindrical element 66 is formed as a continuous thin-film cylindrical expanse. In one general embodiment, the cylindrical expanse is formed by first producing a planar rectangular SMA thin-film expanse by sputtering, wrapping the expanse on a cylindrical mandrel, then annealing the expanse in its cylindrical form. Alternatively, the flat rectangular expanse could be annealed in its planar form, then rolled (in a stress-induced martensite form) and its free edge welded or joined to produce the cylinder.

Alternatively, a cylindrical expanse can be formed by sputtering the SMA alloy onto a cylindrical substrate which is (i) coated with an etchable coating material, and (ii) rotated during sputtering. After the cylindrical thin-film expanse has reached a desired thickness, e.g., a selected thickness between 5–50 microns, the expanse may be further treated, e.g., by photolithography, to produce a desired pattern of openings (not shown) and then released by the substrate by etching the substrate coating.

The wire article may be formed substantially as described for article 40, that is, either by coextrusion of the elements forming the article or by polymer infusion and/or coating methods.

Figure 7:
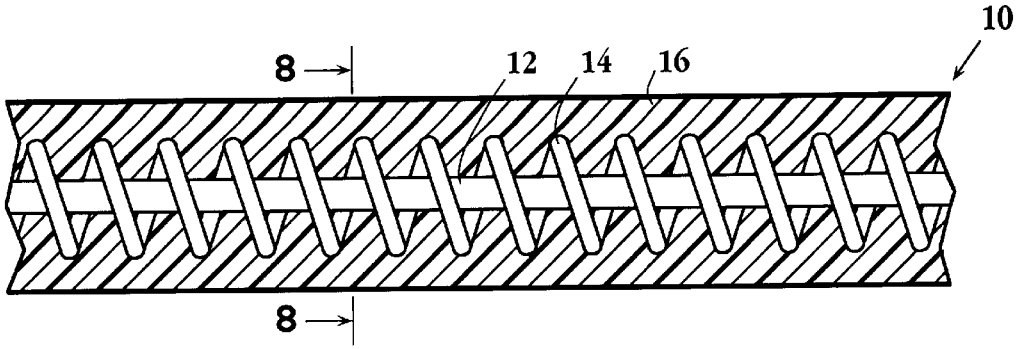
FIG. 7 shows a side-sectional view of a portion of a conductor article constructed according to a fourth embodiment of the invention.
Figure 8:
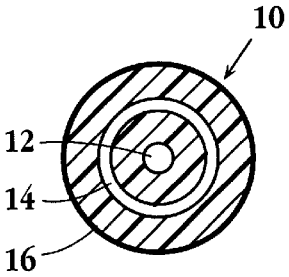
FIG. 8 is a cross-sectional view of the article in FIG. 7, taken along section plane 8—8 in FIG. 7.

FIGS. 7 and 8 illustrate a conductive wire article 10 formed in accordance with a fourth embodiment of the invention. The article generally includes, similar to article 40, a conductive wire 12, a coiled SMA wire element 14 which is coaxially disposed with respect to the wire, and a polymer sleeve 16 encasing the wire and SMA element. The polymer sleeve includes an inner sleeve layer 16A disposed between wire 12 and element 14, and an outer sleeve layer 16B covering element 14.

The SMA wire forming element 14 is an SMA alloy having the above-described properties, a wire thickness between 25 and 250 microns and a helical pitch which may vary from a few degrees (an essentially closed coil) or several degrees (an open coil). The coil is formed by wrapping an SMA wire about a mandrel or the like, and annealing the coil in its cylindrical shape.

The wire article may be formed substantially as described for article 40, that is, either by coextrusion of the elements forming the article or by polymer infusion and/or coating methods.

Figure 10:
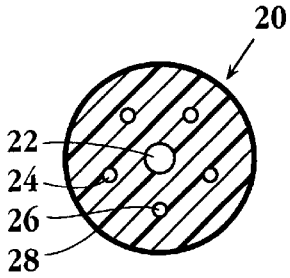
FIG. 10 is a cross-sectional view of the article in FIG. 9 taken along section plane 10—10 in FIG. 9.
Figure 9:
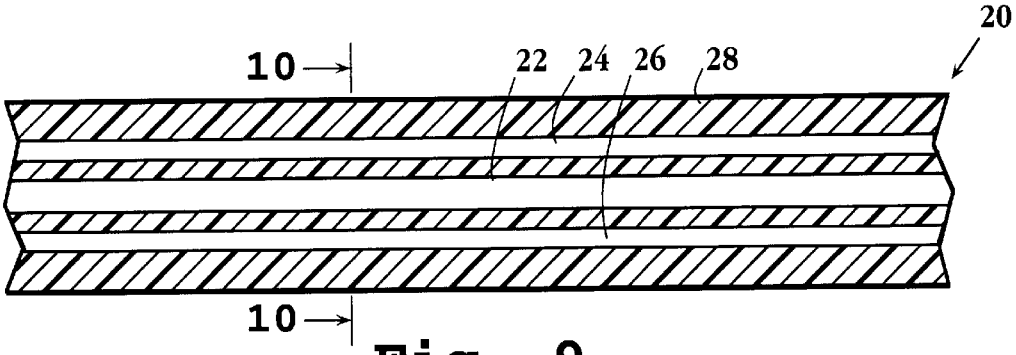
FIG. 9 shows a side-sectional view of a portion of a conductor article constructed according to a fifth embodiment of the invention.

FIGS. 9 and 10 show an embodiment of an article 20 having an elongate conductive wire 22 embedded coaxially within an insulative polymeric sleeve 28. A plurality of SMA wire elements, such as elements 24, 26, are arrayed symmetrically about the conductive wire, as seen in cross section in FIG. 10, forming the SMA element of the article. These wires are embedded in the polymeric covering and are substantially co-extensive with conductive wire. The wires divide the cross-section of the article into inner and outer sleeve layers 28A, 28B, respectively. The article may be formed by coextruding the article components, or by alternative dipping, molding, or spraying techniques that are known for wire production.

Figure 12:
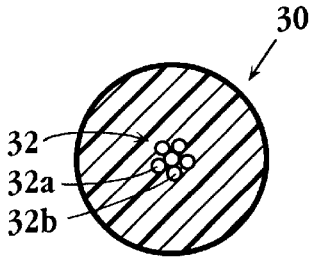
FIG. 12 is a cross-sectional view of the article in FIG. 11, taken along section plane 12—12 in FIG. 5.
Figure 11:
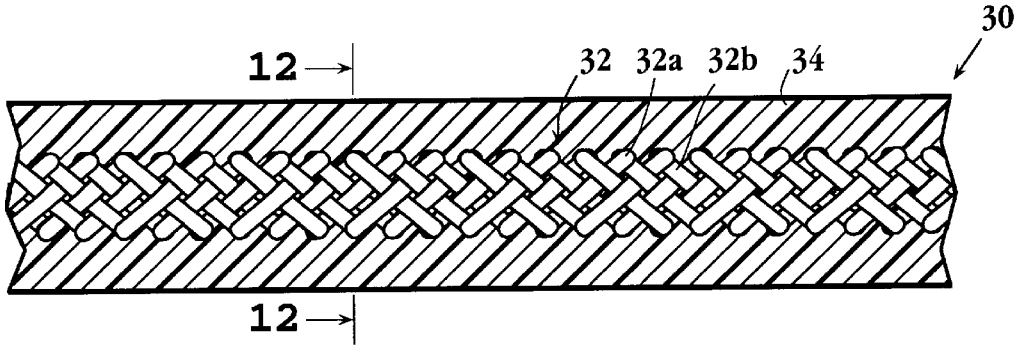
FIG. 11 shows a side-sectional view of a portion of a conductor article constructed according to a sixth embodiment of the invention.

FIGS. 11 and 12 show an embodiment of an article 30 having a central wire-strand braid 32 formed of interwoven or braided conductive wire strands, such as wire strand 32A, and SMA wire elements, such as elements 32B. The braid typically includes 4–20 such wire strands and elements which are woven together according to standard wire braiding techniques. The strands and elements may have diameters ranging from 25 to 250 microns. The braid is coated by or coextruded with the polymer covering 34 according to known methods.

Figure 13A:
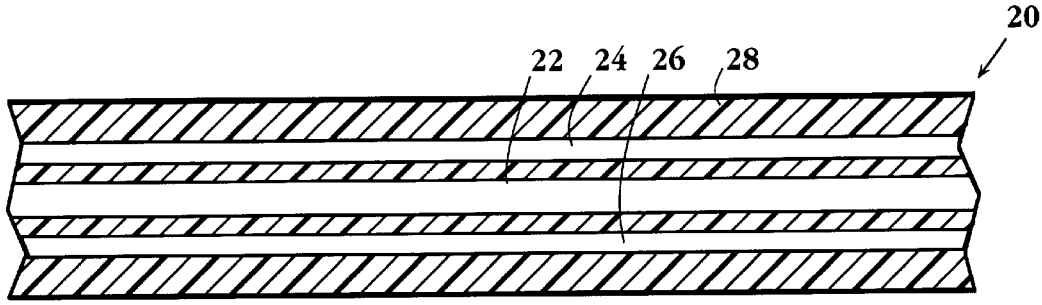
FIGS. 13A and 13B show a portion of the article in FIG. 9 in a predisposed linear shape (13A) and a deformed, bent state (13B)
Figure 13B:
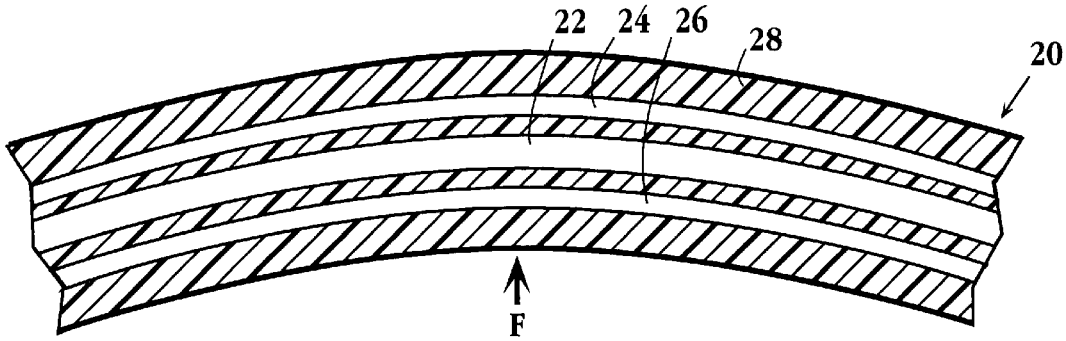

The states of the articles above, including the construction and properties thereof, are substantially as described above. The important pseudoelastic properties of the article can be appreciated from FIGS. 13A and 13B, which show article 20 in a predisposed straight-wire shape (13A), and in a bend shape (13B). As can be appreciated, bending the wire causes SMA elements in the outer arc of the bent article, such as element 24, to be stretched along its length, and SMA elements in the inner arc of the bent article, such as wire 26 to be compressed along its length. In the absence of pseudoelasticity, the SMA elements would undergo plastic deformation, and over time would tend to fatigue with continued stress.

The stress-strain curve in FIG. 14 illustrates the pseudoelastic behavior of the SMA element(s) in the article. Initially, from an unstressed condition (13A), application of stress causes a small amount of elastic deformation and strain in the element. As the stress is increased, at a temperature between the SMA $A_f$ and $M_d$, the article begins to exhibit pseudoelastic behavior as more of the element undergoes the transformation to stress-induced martensite. During this transformation, the element expands elastically with very little change in stress, e.g., due to bending as in FIG. 13B. Similarly, when stress is relieved, e.g., when the articles is allowed to return to its predisposed condition, the SMA element(s) return to their austentitic state elastically, with little change in stress.

This pseudoelastic behavior allows the article to be repeatedly bent with a minimum of stress on the SMA elements, which would otherwise cause element fatigue with repeated mechanical stretching and compressing. The fatigue resistance of the elements, in turn, is imparted to the article as a whole, helping to maintain the integrity of the polymer covering against cracking or splitting. As a result, the article as a whole is substantially more fatigue resistant that a conventional wire with or without reinforcing fibers or strands in the polymeric covering.

It is claimed:

1. An insulated, fatigue-resistant conductive article comprising:

a conductive wire, a polymeric insulative sleeve having inner and outer layers, and a shape memory alloy (SMA) element comprising a fenestrated ribbon having a thickness between 2 and 250 microns, an undeformed austentitic state, an $A_f$ between about −10° C. and 35° C., a pseudoelasticity character above its $A_f$, and demonstrating a stress/strain recovery greater than 3% above its $A_f$, wherein the wire is encased in said inner layer of the sleeve;

wherein the inner layer of the sleeve is surrounded by the SMA element;

wherein the SMA element is encased in the outer layer of the sleeve; and 1 wherein the SMA element can undergo pseudoelastic expansion by stress-induced martensite in response to bending of the conductive article, to resist bending fatigue and thereby prevent the polymeric insulative sleeve from cracking or splitting in response to fatigue in the sleeve material.

2. The article of claim 1, wherein the SMA element has a selected curvature along its length in its austenite form, biasing the article toward this curvature in the absence of a bending force applied to the wire.

3. The article of claim 1, wherein the SMA element is substantially straight along its length in its austenite form, biasing the article toward a straight condition in the absence of a bending force applied to the wire.

4. The article of claim 1, wherein the SMA element is a thin-film ribbon helically wound about the sleeve inner layer, and the ribbon has a thickness of between about 2 and 100 microns and a ribbon width between about 0.5 and 20 mm.

5. The article of claim 1, wherein the helical ribbon has a variable helical pitch, a variable ribbon thickness width, or a variable fenestration area along its length, producing an SMA material gradient along the length of the article.

6. The article of claim 1, wherein the SMA element is a thin-film cylindrical sleeve having a thickness of between about 2 and 100 microns.

7. The article of claim 1, wherein the SMA element is a wire or ribbon braid.

8. The article of claim 1, wherein the SMA element is a coiled wire.

9. The article of claim 1, wherein the SMA element comprises a plurality of elongate SMA elements, each extending substantially along the length of the article between the two sleeve layers.

10. The article of claim 1, wherein the sleeve inner and outer layers have different polymer compositions and the sleeve outer layer is formed of a biocompatible polymer.

11. A pacemaker having, as pacemaker leads, conductive articles in accordance with claim 1.

12. An insulated, fatigue-resistant conductive article comprising:

a conductive wire, a polymeric insulative sleeve having inner and outer layers, and a shape memory alloy (SMA) element comprising a thin-film ribbon helically wound about the sleeve inner layer and having a thickness of between about 2 and 100 microns and a ribbon width between about 0.5 and 20 mm, an $A_f$ between about −10° C. and 35° C., a pseudoelasticity character above its $A_f$, and demonstrating a stress/strain recovery greater than 3% above its $A_f$, wherein the wire is encased in an inner layer of the sleeve; the inner layer of the sleeve is surrounded by the SMA element; the SMA element is encased in the outer layer of the sleeve, the SMA element can undergo pseudoelastic expansion by stress-induced martensite in response to bending of the conductive article, to resist bending fatigue and thereby prevent the polymeric insulative sleeve from cracking or splitting in response to fatigue in the sleeve material; and the helical ribbon has a variable helical pitch, a variable ribbon thickness or width, or a variable fenestration area along its length, producing an SMA material gradient along the length of the article.

13. The article of claim 12, wherein the SMA element has a selected curvature along its length in its austenite form, biasing the article toward this curvature in the absence of a bending force applied to the wire.

14. The article of claim 12, wherein the SMA element is substantially straight along its length in its austenite form, biasing the article toward a straight condition in the absence of a bending force applied to the wire.

15. The article of claim 12, wherein the SMA element is a thin-film cylindrical sleeve having a thickness of between about 2 and 100 microns.

16. The article of claim 12, wherein the SMA element is a wire or ribbon braid.

17. The article of claim 12, wherein the SMA element is a coiled wire.

18. The article of claim 12, wherein the SMA element comprises a plurality of elongate SMA elements, each extending substantially along the length of the article between the two sleeve layers.

19. The article of claim 12, wherein the sleeve inner and outer layers have different polymer compositions, and the sleeve outer layer is formed of a biocompatible polymer.

20. A pacemaker having, as pacemaker leads, conductive articles in accordance with claim 12.

* * * * *